United States Patent [19]

Fenner, Jr.

[11] Patent Number: 4,757,548

[45] Date of Patent: Jul. 12, 1988

[54] SPEAKER SYSTEM AND DOME-SHAPED ENCLOSURE THEREFOR

[76] Inventor: Thomas C. Fenner, Jr., 4842-C E. Kentucky Ave., Denver, Colo. 80222

[21] Appl. No.: 803,146

[22] Filed: Dec. 2, 1985

[51] Int. Cl.[4] ..... H04R 9/04; H04R 1/02; H04R 1/44

[52] U.S. Cl. ..... 381/189; 5/451; 128/33; 367/131; 367/175; 367/182; 367/188; 381/151; 381/152; 381/188; 381/194; 381/199

[58] Field of Search ..... 381/189, 192, 152, 159, 381/188, 194, 199, 201, 205, 151; 5/451; 128/33; 367/131, 135, 141, 174, 175, 182, 188

[56] References Cited

U.S. PATENT DOCUMENTS

| | | | |
|---|---|---|---|
| Re. 23,724 | 10/1953 | Seabert | 381/189 |
| 1,051,543 | 1/1913 | Blake | 367/131 |
| 1,383,700 | 7/1921 | Egerton | 381/180 |
| 1,640,538 | 8/1927 | Bois-Reymond | 367/175 |
| 2,115,098 | 4/1938 | Engholm | 381/205 |
| 2,145,963 | 2/1939 | Adams | 181/153 |
| 2,778,882 | 1/1957 | Pontzen et al. | 381/188 |
| 2,821,191 | 1/1958 | Paii | 128/33 |
| 3,085,568 | 4/1963 | Whitesell | 128/33 |
| 3,384,719 | 5/1968 | Lanzara | 381/159 |
| 3,435,910 | 4/1969 | Lahti | 181/153 |
| 3,524,027 | 8/1970 | Thurston et al. | 381/194 |
| 3,567,870 | 3/1971 | Rivera | 381/194 |
| 3,872,526 | 3/1975 | Betts | 5/451 |
| 3,925,627 | 12/1975 | Ashworth | 381/152 |
| 3,987,258 | 10/1976 | Tsutsui et al. | 381/189 |
| 4,023,566 | 5/1977 | Martinmaas | 128/33 |
| 4,055,170 | 10/1977 | Nohmura | 381/205 |
| 4,064,376 | 12/1977 | Yamada | 297/217 |
| 4,082,159 | 4/1978 | Petty | 181/153 |
| 4,105,024 | 8/1978 | Raffel | 5/451 |
| 4,124,249 | 11/1978 | Abbeloos | 297/217 |
| 4,179,009 | 12/1979 | Birkner | 381/205 |
| 4,187,568 | 12/1980 | McMullan et al. | 5/451 |
| 4,219,099 | 8/1980 | Sacks | 181/153 |
| 4,287,582 | 9/1981 | Tocquet | 367/174 |
| 4,399,334 | 8/1983 | Kakiuchi et al. | 381/194 |
| 4,507,816 | 4/1985 | Smith, Jr. | 5/451 |
| 4,514,599 | 4/1985 | Yanagishima et al. | 381/152 |
| 4,550,428 | 10/1985 | Yamagishima et al. | 381/194 |
| 4,635,287 | 10/1984 | Hirano | 128/33 |

FOREIGN PATENT DOCUMENTS

| | | | |
|---|---|---|---|
| 2115190 | 10/1972 | Fed. Rep. of Germany | 5/451 |
| 2745002 | 7/1978 | Fed. Rep. of Germany | 128/33 |

*Primary Examiner*—Jin F. Ng
*Assistant Examiner*—Danita R. Byrd
*Attorney, Agent, or Firm*—John E. Reilly

[57] ABSTRACT

A speaker system having a magnet and voice coil are mounted within a dome-shaped enclosure in such a way as to be capable of transmitting sonic vibrations and audio waves through a liquid medium or solid structure, the dome-shaped enclosure cooperating with the magnet and voice coil in such a way as to greatly enhance the waves and sonic vibrations generated to the other medium or structure.

16 Claims, 2 Drawing Sheets

SPEAKER SYSTEM AND DOME-SHAPED ENCLOSURE THEREFOR

This invention relates to speaker systems and more particularly relates to a novel and improved speaker system and enclosure for the components of a speaker in transmitting both physical and sonic vibrations to liquid and solid media.

BACKGROUND AND FIELD OF THE INVENTION

It has long been recognized that certain beneficial effects can be realized from the placement of speaker systems in direct proximity to an article of furniture, such as, a chair or waterbed whereby the occupant of the chair or bed receives direct physical vibrations while listening to the music or information broadcast through the speaker systems. In fact, it is known that to some exent auditory response is possible through the generation of physical vibrations in certain parts of the body, such as, the chest wall if those vibrations are properly and directly transmitted through selected locations in the body.

In the past, a number of approaches have been taken to strategic placement of speaker systems in direct association with a chair or waterbed in an effort to achieve the desired auditory and physical vibrational impulses. A representative approach is that disclosed in U.S. Pat. No. 4,023,566 to W. W. Martinmaas in which a loud speaker is mounted in immediate confronting proximity to a loud speaker opening, the loud speaker connected to an amplifier so as to produce vibrations of the air within a speaker chamber which are in the audible frequency range. The chamber is defined by a sheet of material which forms the top of the housing and has its periphery secured to a plurality of connected walls which form a base structure for an article of furniture. A person occupying the article of furniture will receive the vibrations produced within the chamber. In Martinmaas, the chamber itself is defined by the connecting walls of the article of furniture much in the form of a speaker cabinet. A similar approach is taken in U.S. Pat. No. 4,064,376 to K. Yamada.

In U.S. Pat. No. 3,085,568 to H. Whitesell vibratory impulses are directed through a waterfilled support cushion by means of a standard loudspeaker or pump directly coupled to the bottom of the cushion. Similarly, U.S. Pat. No. 3,872,526 to P. J. Betts employs a motor-driven eccentric weight to transmit vibrations to a flexible sheet which is supported within the frame of a waterbed.

U.S. Pat. No. 4,124,249 to C. J. Abbeloos similarly suggests the use of a plurality of loudspeaker chambers for directing monaural or stereophonic sound through an article of furniture but employs standard loudspeaker housings installed in specially formed chambers which define a part of the furniture itself.

In U.S. Pat. No. 4,507,816 to G. H. Smith, Jr., a series of speakers are mounted beneath a waterbed so that the sound waves projected from the speakers cause undulations in the water within the mattress. Here the speakers are located beneath the four corners of the waterbed with each speaker enclosed in an airtight, acoustically insulated housing that extends from the floor to the deck of the bed.

Another patent of interest is U.S. Pat. No. 2,821,191 to A. Y. Pai.

The present invention is directed more to the novel and improved construction and arrangement of a speaker enclosure which greatly enhances the sonic and physical vibrational impulses generated by the loudspeaker components and wherein the speaker is readily conformable for use with different articles of furniture but has particular characteristics which make it most suitable for use in combination with waterbeds.

SUMMARY OF THE INVENTION

Accordingly, it is an object of the present invention to provide for a novel and improved speaker housing which is rugged and compact and readily conformable for use with different articles of furniture in transmitting sonic and physical vibrations thereto.

Another object of the present invention is to provide for a novel and improved speaker system including the housing or sound chamber which is conformable for placement directly beneath or against objects, such as, waterbed mattresses for the direct transmission of physical and sonic vibrations thereto in a manner which will optimize both the auditory and physical response to an occupant of the waterbed mattress.

A further object of the present invention is to provide in a speaker system for a novel and improved watertight enclosure capable of imparting varied frequency response to different surfaces, which eliminates crossover characteristics of conical couplings used in standard speaker systems and further is so constructed and arranged as to be capable of transmitting sound waves in freestanding water as well as other media without danger of electrical shock.

It is an additional object of the present invention to provide a vibrational speaker system which can be placed against other objects or directly fastened to other objects to efficiently transmit sound and physical vibrations to that object, and is characterized in particular by its ability to be used in association with a waterbed mattress either singly or in pairs to most efficiently transmit sound and physical vibrations through the waterbed to a person or persons resting on the bed.

In accordance with the present invention, there has been devised a speaker system for transmitting sonic and physical vibrational impulses which is comprised of the combination of a dome-shaped enclosure having an arcuate shell and a support member mounted therein, a magnet positioned in an opening in the support member for extension in a direction away from the apex of the enclosure, the magnet provided with a central recessed portion aligned with the opening in the support member, and a voice coil including means mounting the coil at the apex of the enclosure for rearward extension concentrically with respect to the recessed portion of the magnet whereby placement of the enclosure in direct association with a liquid medium or solid structure will cause both sonic and physical vibrational impulses to be transmitted to the medium or structure.

The above and other objects, advantages and features of the present invention will become more readily understood and appreciated from a consideration of the following detailed description of a preferred embodiment of the present invention when taken together with the accompanying drawings in which:

DETAILED DESCRIPTION OF THE PREFERRED EMBODIMENT

Figure 1:
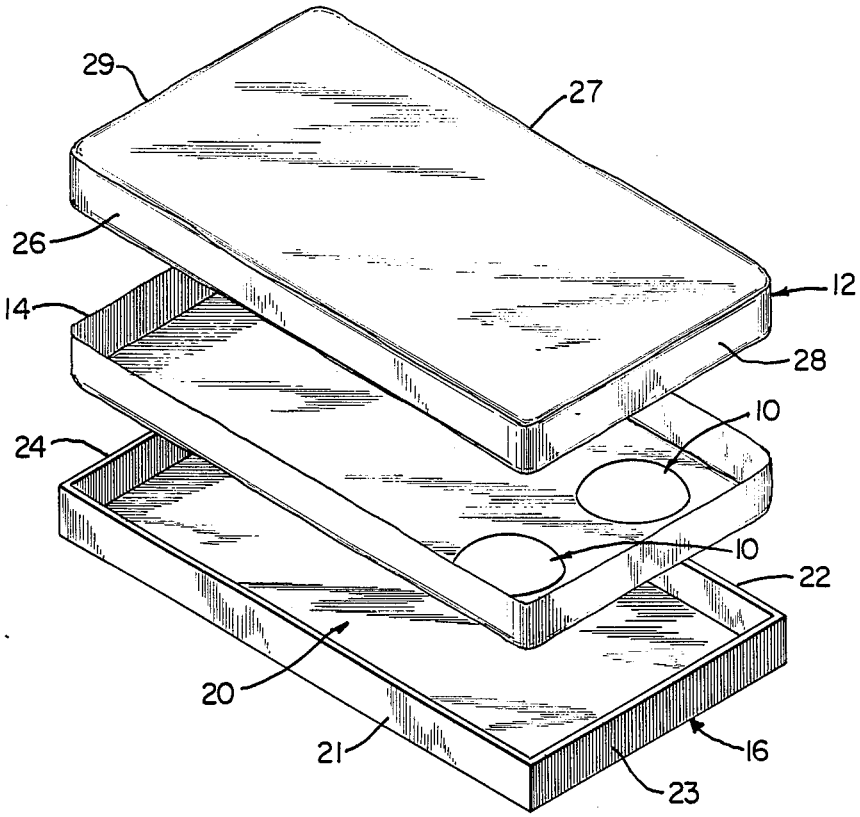
FIG. 1 is a perspective view in exploded form illustrating a preferred form of speaker system for installation in a standard waterbed.
Figure 2:
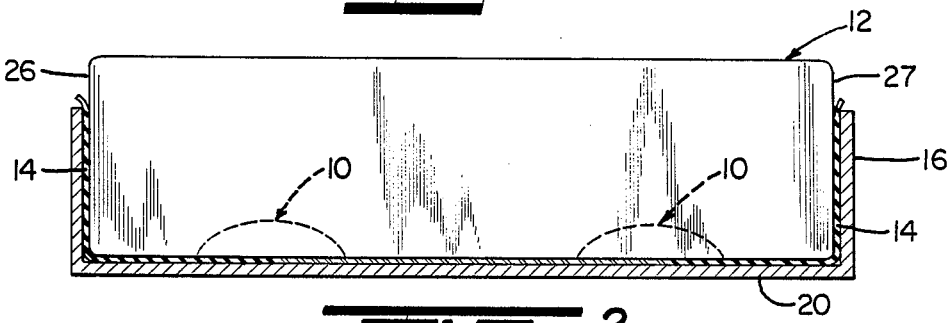
FIG. 2 is a cross-sectional view illustrating the mounting of a pair of speaker systems between a waterbed mattress and frame.

Referring to FIGS. 1 and 2, there is shown by way of illustrative example the mounting of a pair of loudspeaker systems 10 in a waterbed made up of a water-filled mattress or envelope 12, a liner 14 and a generally rectangular base frame 16. As noted from FIG. 2, and in accordance with conventional practice, both the envelope 12 and liner 14 are composed of a rubber or rubber-like material which will retain liquid and possess the desired flexibility and comfort for resting or sleeping. However, the base frame 16 is typically of a rigid material, such as, metal or wood and which is comprised of a bottom panel 20, side panels 21 and 22, head and foot end panels 23 and 24, respectively. The frame is formed in this manner to lend some support to opposite sides 26, 27, head end 28 and foot end 29 of the envelope or mattress 12. In this relation, a pair of loudspeaker systems 10 are positioned at or adjacent to the head end of the mattress 12 and preferably are interposed between the liner 14 and mattress 12.

Figure 3:
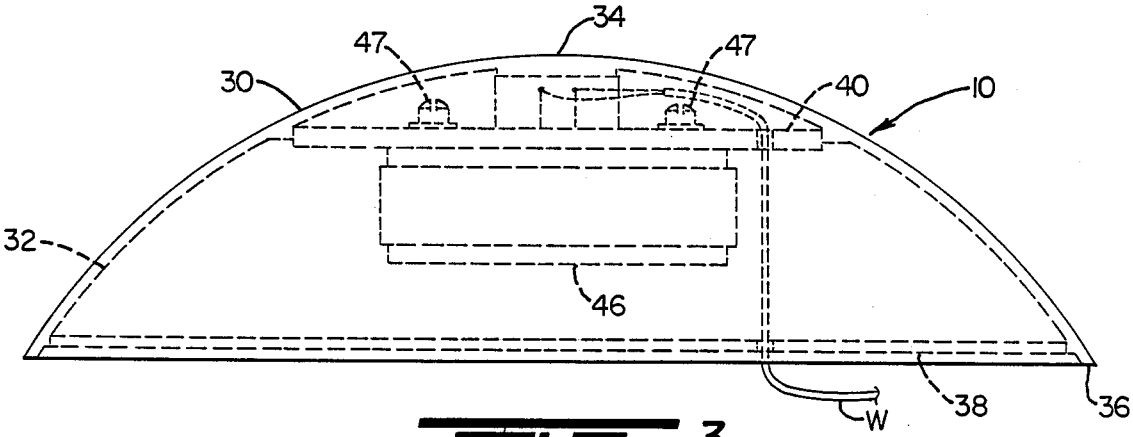
FIG. 3 is an enlarged cross-sectional view of the preferred form of speaker system in accordance with the present invention.
Figure 4:
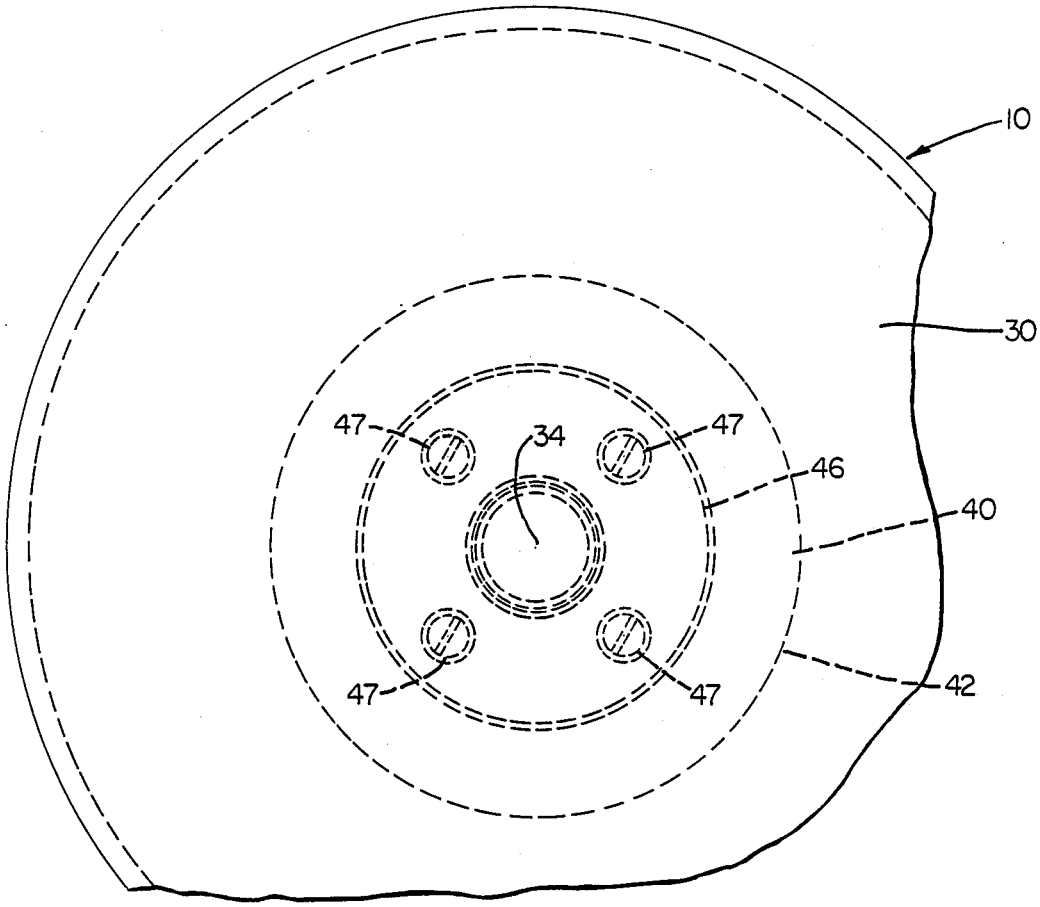
FIG. 4 is a somewhat fragmentary end view of a preferred form of speaker system.
Figure 5:
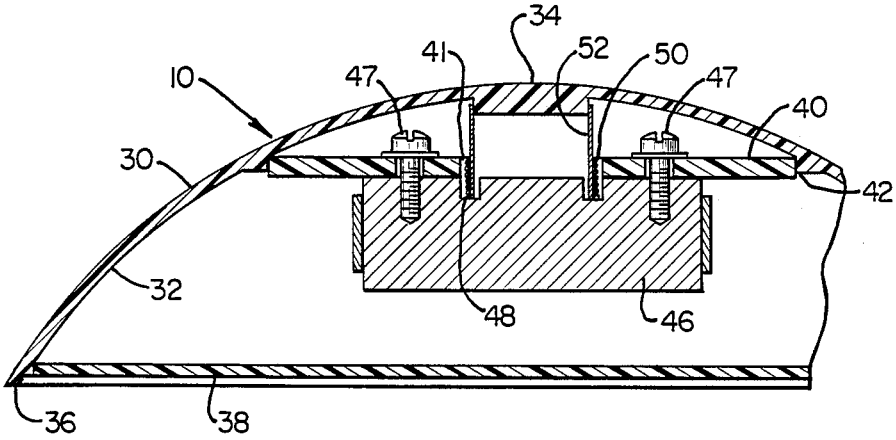
FIG. 5 is an enlarged cross-sectional view of a preferred form of speaker system in accordance with the present invention.

The preferred form of speaker system is illustrated in detail in FIGS. 3 to 5 and is broadly comprised of a dome-shaped enclosure 30 having an arcuate wall or shell 32 of generally spherical configuration, an apex 34 at its forward extremity and a rearward circumferential edge 36. A flat generally circular panel 38 extends across the circumferential edge and is sealed thereto so as to form an air and watertight enclosure.

Positioned within the enclosure 30 is a generally circular support plate 40 which is permanently affixed, such as, by suitable bonding or welding to an internally projecting rib 42 on the inner surface of wall portion 32. It will be noted that support plate 40 extends chordally across the wall 32 at an intermediate portion thereof and in adjacent but spaced relation to the apex so as to be relatively near the apex and away from the rearward edge 36. As most clearly seen from FIG. 5, the plate 40 is provided with a central opening 41 aligned in axially spaced relation to the apex 34 of the enclosure. A magnet 46 is of generally circular configuration and is mounted on the rear surface of the plate 40 by suitable attaching screws 47 so that the magnet extends rearwardly away from the support plate. Recessed portion 48 is disposed centrally of the driver and is aligned with the center opening 41 for insertion of a voice coil 50 and its support core 52, the core 52 extending rearwardly away from a closed end which is attached to the inner wall surface of the shell 30 at its apex 34.

Preferably, the shell 30, rear panel 38 and support plate 40 are composed of a "PLEXIGLAS" material and which as stated are welded together so as to form a watertight enclosure. Independent suspension of the coil driver 50 and magnet 46 has been found to achieve optimum frequency response and eliminate cross-over characteristics inherent in conical speaker housings. In this relation, the generally dome-shaped enclosure offers a broad surface area and the ability not only to transmit sound but physical vibrational impulses as well, principally as a result of the oscillatory movement of the coil 50 with respect to the magnet and its support plate 40. Thus, the enclosure is particularly useful in imparting a combination of sonic and physical vibrations to another article, such as, the waterbed assembly shown in FIGS. 1 and 2.

Most desirably, a pair of speaker units 10 are positioned with the apex 34 of the shell 30 directed upwardly into direct surface contact with the envelope 12 of the waterbed. Although the speaker units are illustrated as being mounted in closely spaced relation at the head end of the bed between the liner and mattress, it will be apparent that this positioning may be modified somewhat; or, if desired, another pair of speaker units may be mounted at the foot end. Nevertheless, optimum characteristics have been found to be imparted to the waterbed mattress when a pair of speaker units are mounted at the head end as shown so as to transmit the sonic and physical vibrations directly to the underside of the mattress and to create undulations or waves in the contained water. As illustrated in FIG. 3, suitable wiring W extends from connection to terminals for the voice coil for connection via an external two-wire connector secured to the base 38 to an amplifier section of a tuner in order to transmit sound to the voice coil.

Figure 6:
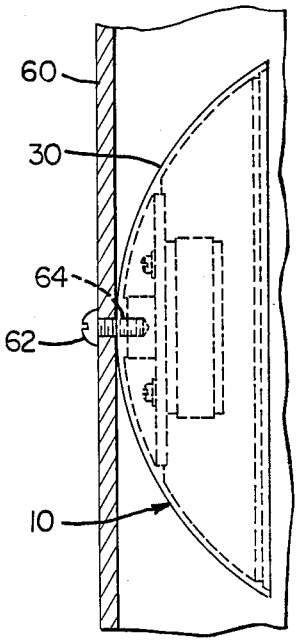
FIG. 6 is a side view illustrating the mounting of the preferred form of speaker system to a panel which may be representative of a wall panel or an article of furniture.

FIG. 6 illustrates an adaption of a speaker unit 10 of the present invention to a solid structure, such as, a wall panel. Here a wall panel is generally designated at 60 but is merely representative of any flat panel whether it be a wall or frame portion of a piece of furniture. In order to effectively impart vibrations to the article 60, the speaker unit 10 is directly affixed to the article 60 by an attaching screw 62 extending through a bore in the member 60 and a threaded bore 64 of the shell 30 and specifically at the apex 34 of the shell 30 but in inner spaced concentric relation within the voice coil core 52. The sound or audio frequencies transmitted will set up not only sonic but vibrational impulses in the magnet 46 which are in turn radiated into the wall 32 of the shell 30. The "PLEXIGLAS" composition of the shell has been found to be most effective in transmitting both sonic and physical waves into another article to which it is attached or with which it is in contact.

By way of illustration and not limitation, a "PLEXIGLAS" shell structure 30 was formed with a ⅛" thick dome approximately 14" in diameter and 3½" high at its apex. A 40-ounce magnet 46 was positioned on the support plate 40, the diameter of the magnet being 4½" with a 1½" height. The support core 52 was approximately 1½" diameter with a 1½" height. The support core was secured to the apex of the shell and the magnet secured to a support plate 40 approximately 6" in diameter and ¼" thick, the attachment being made by four equally spaced attaching screws 47 joining the magnet/voice coil assembly to the support plate. The support plate 40 was secured to the outer rib 42 with a suitable liquid bonding agent. The base plate 38 similarly was sealed to the edge 36 with an adhesive material, the base plate being 14" in diameter and approximately ⅛" thick. Electrical connection was accomplished through two lengths of speaker wire approximately 9" long soldered to the terminals of the voice coil and to an external two-wire connector secured to the base plate 38 with liquid adhesive. Also, the wires W were secured to the inside of the dome with liquid adhesive and in accordance with standard practice were insulated from each other.

From the foregoing, it will be seen that a novel and improved speaker system has been devised in which the modular design of the speaker housing allows placement in waterbeds and the like without disassembly. The unit is both watertight and airtight so as to prevent electrical shock if submerged in water and will transmit sonic waves in freestanding water that are perceivable to the human ear. By the addition of a fastener element to the center of the speaker enclosure, it may be attached to various substructures of different articles, such as, wall structures, chairs, bed frames or bed mattresses including waterbeds. The smooth surface of the dome-shaped enclosure minimizes the possibility of punctures or damage to the waterbed while being capable of imparting varied frequency response against the surface area of the bed. The dome design offers more surface area per linear measurement than flat surfaces or conical chambers thus increasing frequency response due to increased displacement. Further, the dome design eliminates cross-over characteristics of conical couplings, for example, used in standard speaker designs so as to achieve high fidelity in varied matrices and accentuate the frequency response.

It is therefore to be understood that various modifications and changes may be made in the construction and arrangement of elements comprising the present invention without departing from the spirit and scope thereof as defined by the appended claims.

I claim:

1. A speaker system for transmitting sonic and physical vibrational impulses to a liquid medium or solid structure, the combination comprising:

a dome-shaped enclosure having an arcuate shell, an apex and a support member mounted within said shell;

a magnet positioned in an opening in said support member and securing means for attaching said magnet to said support member for extension in a direction away from the apex of said enclosure, said magnet provided with a central recessed portion aligned with the opening in said support member; and a voice coil and mounting means for mounting said coil at the apex of said enclosure for independent movement of said coil with respect to said magnet whereby placement of said enclosure in direct association with one of a liquid medium and solid structure will cause both sonic and physical vibrational impulses to be transmitted by said speaker system to a respective one of said medium and structure.

2. In a speaker system according to claim 1, including a panel extending across the rearward open end of said enclosure to define a sealed watertight enclosure.

3. In a speaker system according to claim 2, said dome-shaped enclosure composed of a "PLEXIGLAS" material.

4. In a speaker system according to claim 1, said support member defined by a plate affixed to an intermediate portion of said enclosure spaced from said apex and said magnet extending rearwardly from said support member.

5. In a speaker system according to claim 1, said mounting means extending rearwardly from said apex concentrically through said recessed portion of said magnet.

6. In a speaker system according to claim 4, said support plate being welded to an inner wall surface of said enclosure.

7. In a speaker system according to claim 1, including attaching means disposed at the apex of said enclosure for forward extension externally of said enclosure for attachment to a solid structure.

8. A speaker system in combination with a waterbed having a water-filled envelope and frame partially surrounding said envelope, the improvement comprising:

at least one loudspeaker having a voice coil and a magnet;

a dome-shaped enclosure of generally semi-spherical configuration having an apex and chordally extending support means secured within said enclosure at an intermediate portion thereof, said magnet mounted centrally of said support means for rearward extension therefrom within said enclosure with a recessed portion of said magnet facing the apex of said enclosure, coil mounting means for mounting said coil at the apex of said enclosure, said loudspeaker positioned between said waterbed envelope and said frame with said dome-shaped enclosure bearing aginst the underside of said envelope.

9. In a speaker system according to claim 8, including a panel member enclosing the rearward end of said enclosure in sealed watertight relation.

10. In a speaker system according to claim 8, said enclosure composed of a "PLEXIGLAS" material.

11. In a speaker system according to claim 8, said support means defined by a plate of limited flexibility affixed to the inner wall surface of said enclosure in spaced relation to said apex, said magnet being disposed in a central opening in said plate.

12. In a speaker system according to claim 8, said voice coil and said mounting means extending rearwardly from said apex in inner spaced concentric relation to said recessed portion of said magnet.

13. In a speaker system for transmitting sonic and physical vibrational impulses to a stationary structure, the combination comprising:

a dome-shaped enclosure of generally semi-spherical configuration defining a chamber;

a chordally extending support member mounted within said dome-shaped enclosure;

a magnet positioned in an opening in said support member for extension in a direction away from the apex of said enclosure, said magnet provided with a central recessed portion aligned with the opening in said support member;

a voice coil, and mounting means mounting said coil at the apex of said enclosure for rearward extension therefrom concentrically within the recessed portion of said magnet; and means for attaching said enclosure to said structure.

14. In a speaker system according to claim 13, a panel extending across a rearward end of said enclosure to define a sealed watertight enclosure, said dome-shaped enclosure being composed of a "PLEXIGLAS" material, and said support member defined by a plate affixed to an intermediate portion of said enclosure spaced from said apex and said magnet extending rearwardly from said support member.

15. In a speaker system according to claim 13, said mounting means extending rearwardly from said apex concentrically through said recessed portion of said magnet, said support member welded to an inner wall surface of said enclosure and composed of a material capable of flexing in response to sound transmitted thereto, and said attaching means disposed at the apex of said enclosure for forward extension therefrom.

16. In combination with a wall panel, a speaker system comprising:

at least one loudspeaker having a voice coil and a magnet; and a dome-shaped enclosure of generally semi-spherical configuration having an apex and a chordally extending support plate secured within said enclosure at an intermediate portion thereof, said magnet mounted centrally of said support plate for rearward extension therefrom within said enclosure with a recessed portion of said magnet facing said apex of said enclosure, coil mounting means for affixing said coil to said apex of said enclosure for rearward extension therefrom concentrically within the recessed portion of said magnet, a fastener extending from said enclosure for attachment to a wall panel, a base plate enclosing the rearward end of said enclosure in sealed water-tight relation, said support plate being of limited flexibility and affixed to the inner wall surface of said enclosure in spaced relation to said apex, said magnet being disposed in a central opening in said plate.

* * * * *